US009022825B1

(12) United States Patent
Meyer

(10) Patent No.: US 9,022,825 B1
(45) Date of Patent: May 5, 2015

(54) SELF-INFLATING DEVICE

(71) Applicant: Kevin W. Meyer, Fort Collins, CO (US)

(72) Inventor: Kevin W. Meyer, Fort Collins, CO (US)

(73) Assignee: Otter Products, LLC, Fort Collins, CO (US)

( * ) Notice: Subject to any disclaimer, the term of this patent is extended or adjusted under 35 U.S.C. 154(b) by 0 days.

(21) Appl. No.: 14/594,901

(22) Filed: Jan. 12, 2015

Related U.S. Application Data

(63) Continuation of application No. 13/801,487, filed on Mar. 13, 2013, now Pat. No. 8,961,250.

(51) Int. Cl.
*B63B 22/22* (2006.01)

(52) U.S. Cl.
CPC ..... *B63B 22/22* (2013.01)

(58) Field of Classification Search
CPC ..... B63C 9/24
USPC ..... 441/39, 98
See application file for complete search history.

(56) References Cited

U.S. PATENT DOCUMENTS 3,566,426 A * 3/1971 Davidson et al. ..... 441/31
3,777,692 A * 12/1973 Baccaglini et al. ..... 114/54
4,312,580 A 1/1982 Schwomma et al.
4,482,081 A * 11/1984 Meggs ..... 222/5
4,498,881 A * 2/1985 Buckle ..... 441/93
4,703,161 A 10/1987 McLean
4,771,299 A 9/1988 Gell
4,929,214 A * 5/1990 Liebermann ..... 446/221
5,286,462 A * 2/1994 Olson ..... 422/305
5,311,394 A * 5/1994 Naab et al. ..... 361/248
5,466,179 A * 11/1995 Jeffrey, Sr. ..... 441/108
5,823,840 A * 10/1998 Powers ..... 441/122
5,941,752 A * 8/1999 Liebermann ..... 446/220
6,164,239 A * 12/2000 Dawson ..... 116/210
6,317,313 B1 11/2001 Mosgrove et al.
6,332,819 B1 * 12/2001 Emmons ..... 441/1
6,359,568 B1 * 3/2002 Johnson ..... 340/691.7
6,669,017 B2 12/2003 Linihan
6,805,071 B2 * 10/2004 Jakubowski, Jr. ..... 116/210
6,899,583 B2 * 5/2005 Barden ..... 441/89
6,976,950 B2 * 12/2005 Connors et al. ..... 600/29
7,004,807 B1 * 2/2006 Summers ..... 441/81
7,232,353 B1 * 6/2007 Gauthier ..... 441/7
7,243,946 B2 * 7/2007 Stevens et al. ..... 280/741
7,264,525 B2 * 9/2007 Tsitas ..... 441/98
7,267,509 B1 * 9/2007 Jackson, III ..... 405/186
7,462,348 B2 * 12/2008 Gruenbacher et al. ..... 424/44
7,484,510 B2 * 2/2009 Connors et al. ..... 128/897
7,789,018 B2 * 9/2010 Burns ..... 102/288
8,016,740 B2 * 9/2011 Connors et al. ..... 600/29

(Continued)

*Primary Examiner* — Lars A Olson
*Assistant Examiner* — Jovon Hayes

(57) ABSTRACT

A pressure-activated flotation device for use with an electronic device includes an attachment feature, chemicals, a container, a removable cap, an inflatable tube, and a pressure-activated valve. The inflatable tube is fluidly connected to the container and is configured to inflate with the expanding gas when the chemicals are exposed to a liquid. The pressure-activated valve leads from the outer surface of the container to the inner volume of the container and includes a one-way valve that opens to allow liquid to flow to the inner volume of the container when the pressure-activated flotation device is submerged in the liquid to a depth where the pressure applied against the pressure-activated valve by the liquid is greater than an actuation pressure. The one-way valve also closes when the expanding gas generates a gas pressure inside the inflatable tube that exceeds a threshold.

20 Claims, 8 Drawing Sheets

(56) References Cited

U.S. PATENT DOCUMENTS

| | | | | |
|---|---|---|---|---|
| 8,297,778 | B2 | 10/2012 | Jeffrey | |
| 8,430,704 | B2 * | 4/2013 | Jeffrey | 441/17 |
| 8,574,146 | B2 * | 11/2013 | Gillespie et al. | 600/30 |
| 2006/0270290 | A1 * | 11/2006 | Tellew | 441/88 |

* cited by examiner

SELF-INFLATING DEVICE

CROSS REFERENCE TO RELATED APPLICATIONS

This application is a continuation of U.S. patent application Ser. No. 13/801,487 filed Mar. 13, 2013, titled "SELF-INFLATING DEVICE" which is herein incorporated by reference in its entirety.

BACKGROUND

Archimedes' principle states that a buoyant force experienced by an object submerged in liquid is equal to the weight of liquid displaced by the object. When an object is submerged in water, the buoyant force provided by the displaced water acts in an upward direction, and the weight of the object acts in a downward direction. If the weight of the water displaced by the submerged object is less than the weight of the object, the object will sink. Alternately, if the weight of the water displaced by the submerged object is more than the weight of the object, the object will float. Electronic devices, such as cellular phones, smartphones, cameras, audio players, video players, two-way radios, and GPS receivers, are often negatively buoyant due to their high densities relative to water. Even when housed in a lightweight protective case, most electronic devices will sink when submerged in water. Consequently, a user risks losing an electronic device that is accidentally dropped into a body of water, such as an ocean, lake, or stream.

BRIEF DESCRIPTIONS OF DRAWINGS

DETAILED DESCRIPTION

Figure 1:
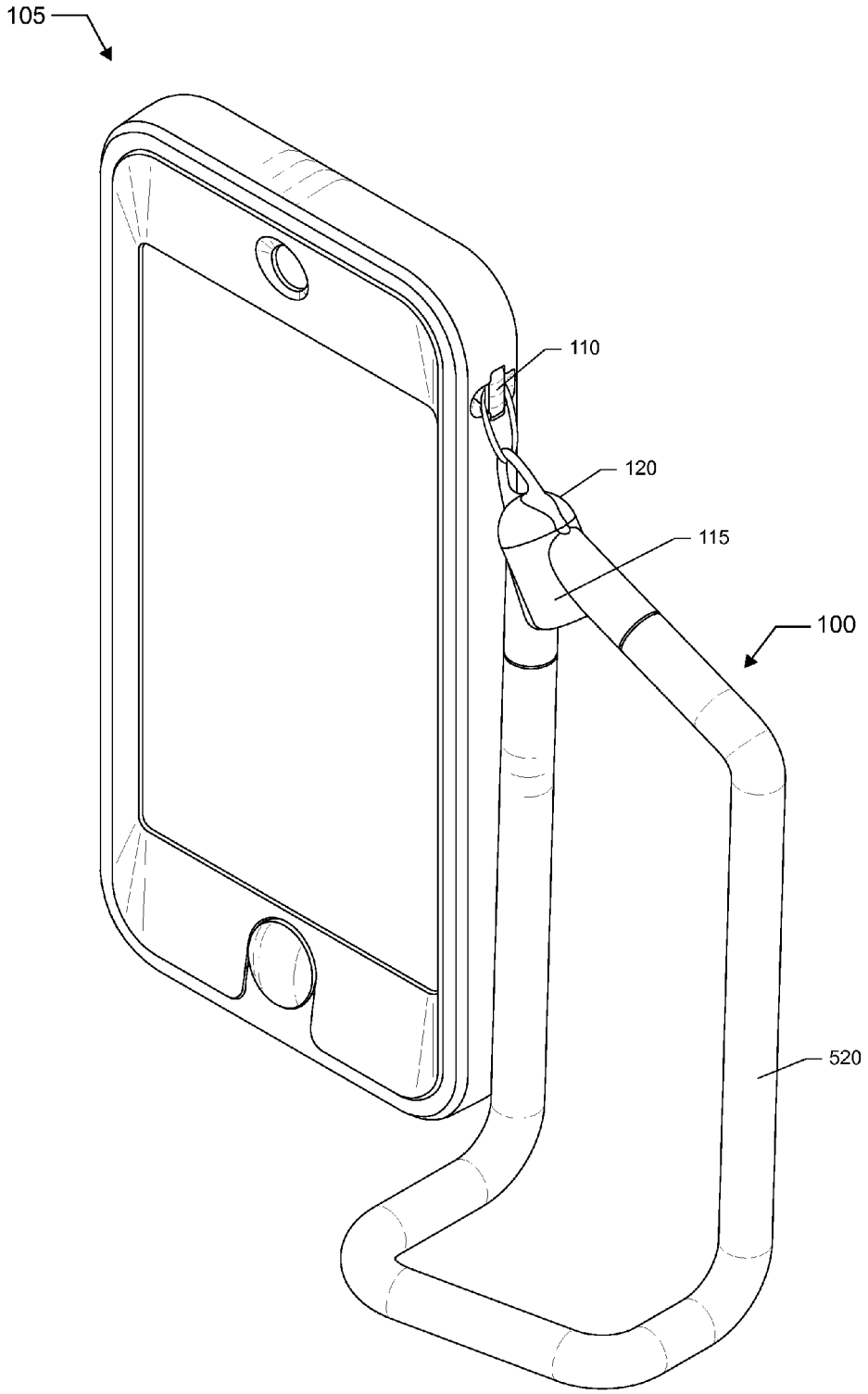
FIG. 1 is a front perspective view of an electronic device installed in a protective case connected to a self-inflating device.

An electronic device, such as, but not limited to, a cellular phone, camera, audio player, video player, smartphone, two-way radio, or GPS receiver, can be enclosed in a protective case 105, such as a waterproof or water-resistant case, as shown in FIG. 1. The combination of the electronic device and the waterproof case 105 may be negatively buoyant in water, so if the electronic device is accidentally dropped into a body of water, the electronic device may be lost. For example, if a user accidentally drops the electronic device into a lake, stream, or river, the user may lose the electronic device as it sinks below the water's surface and out of reach. Similarly, if a user accidentally drops the electronic device into a deep wave pool at a waterpark, the user may lose the electronic device. To prevent the user from losing the electronic device in these situations, or other foreseeable situations, it can be desirable to attach a self-inflating device to, or incorporate a self-inflating device into, the electronic device or the protective case 105 for the electronic device. The self-inflating device can be any suitable size and configuration to effectively increase the buoyancy of the electronic device and return the electronic device to the surface of the body of water.

An electronic device, such as a waterproof camera or a smartphone housed in a waterproof or water-resistant case, can allow a user to capture underwater photographs. For example, while snorkeling, the user can capture underwater photos of their surroundings, including marine creatures and coral formations. Snorkeling excursions are often conducted in relatively shallow water near the perimeter of a body of water. But snorkelers may encounter deeper water when venturing away from shore or when traversing between two points of interest, such as between two coral formations separated by a relatively deep channel. When snorkeling in relatively deep water, a user may have difficulty retrieving a dropped electronic device, e.g., if the user lacks an ability to free dive to the bottom of the body of water. As a result, the user may lose the electronic device as well as any photos that are stored in the device's memory. Another negative outcome is that the sinking electronic device may damage delicate coral formations during its descent to the bottom of the body of water.

To avoid the scenarios described above, and other scenarios, it can be desirable to attach a self-inflating device to the electronic device prior to an aquatic activity. For example, it can be desirable to attach a self-inflating device to a digital camera or protective case 105 containing a smartphone. In one example, it can be desirable for the self-inflating device to inflate only at a depth equal or greater than a predetermined depth, such as 5, 10, or 15 feet. This can allow the user to freely use the electronic device at depths up to the predetermined depth without the self-inflating device inflating. For example, the user can capture photos while snorkeling at common snorkeling depths without the self-inflating device inflating, and the self-inflating device may only inflate if the electronic device drops below the predetermined depth, such as when the user accidentally drops the electronic device.

Figure 8:
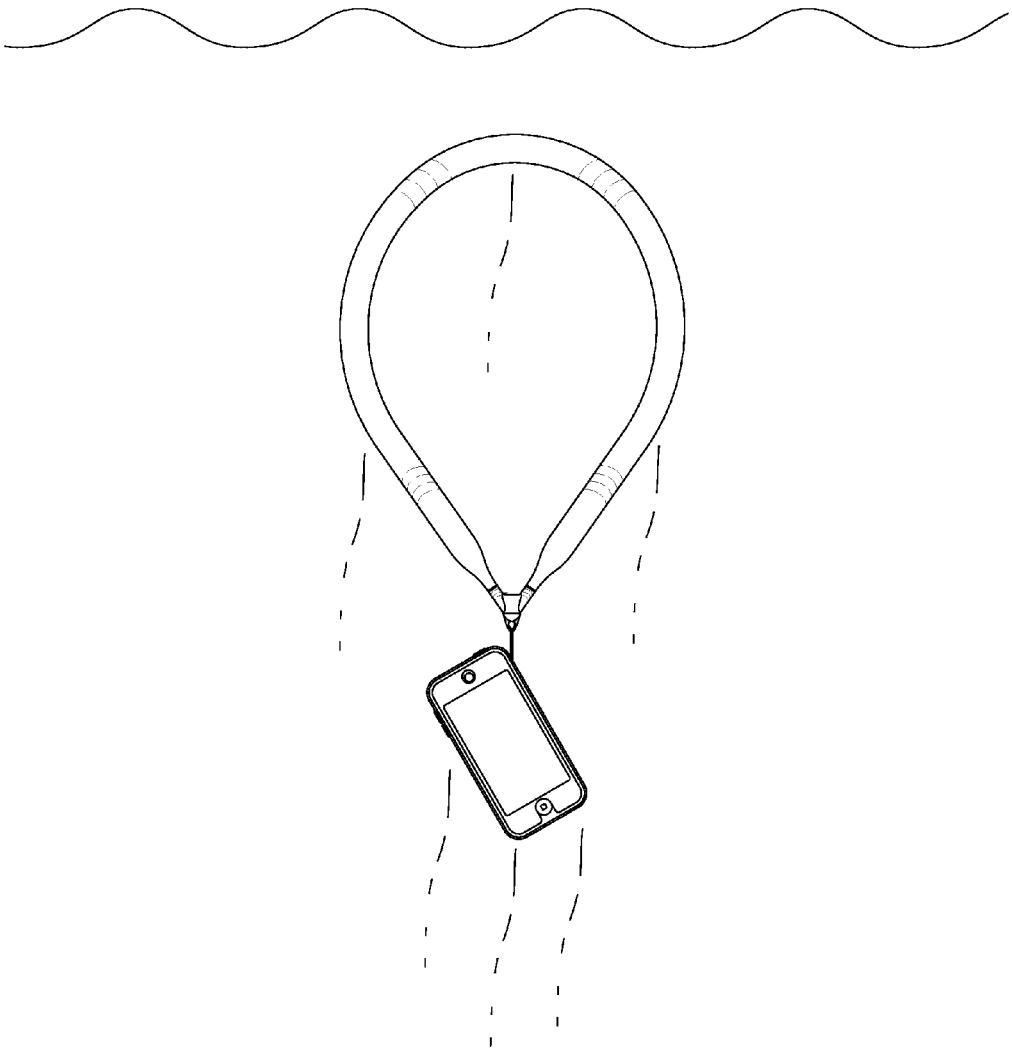
FIG. 8 shows an inflated self-inflating device carrying an electronic device installed in a protective case to the surface of a body of water.

In one example shown in FIGS. 1 and 8, the self-inflating device 100 can be a self-inflating lanyard forming a loop that can be wrapped around a user's body, such as a wrist, or attached to a clip on a user's clothing or equipment. The self-inflating device 100 can attach to the electronic device, or to the protective case 105 for the electronic device, by any suitable method, such as by threading around an attachment feature 110 of the case or device. The self-inflating device 100 can include a container 115 having an inner volume. In one example, the inner volume of the container can be about 0.01-0.5, 0.02-0.4, 0.05-0.3, or 0.1-0.2 $in^3$. In another example, the inner volume of the container 115 can be about 0.01-100, 0.01-50, 0.01-25, 0.01-10, 0.01-5, 0.01-3, 0.01-2, or 0.01-1 $in^3$.

Figure 2:
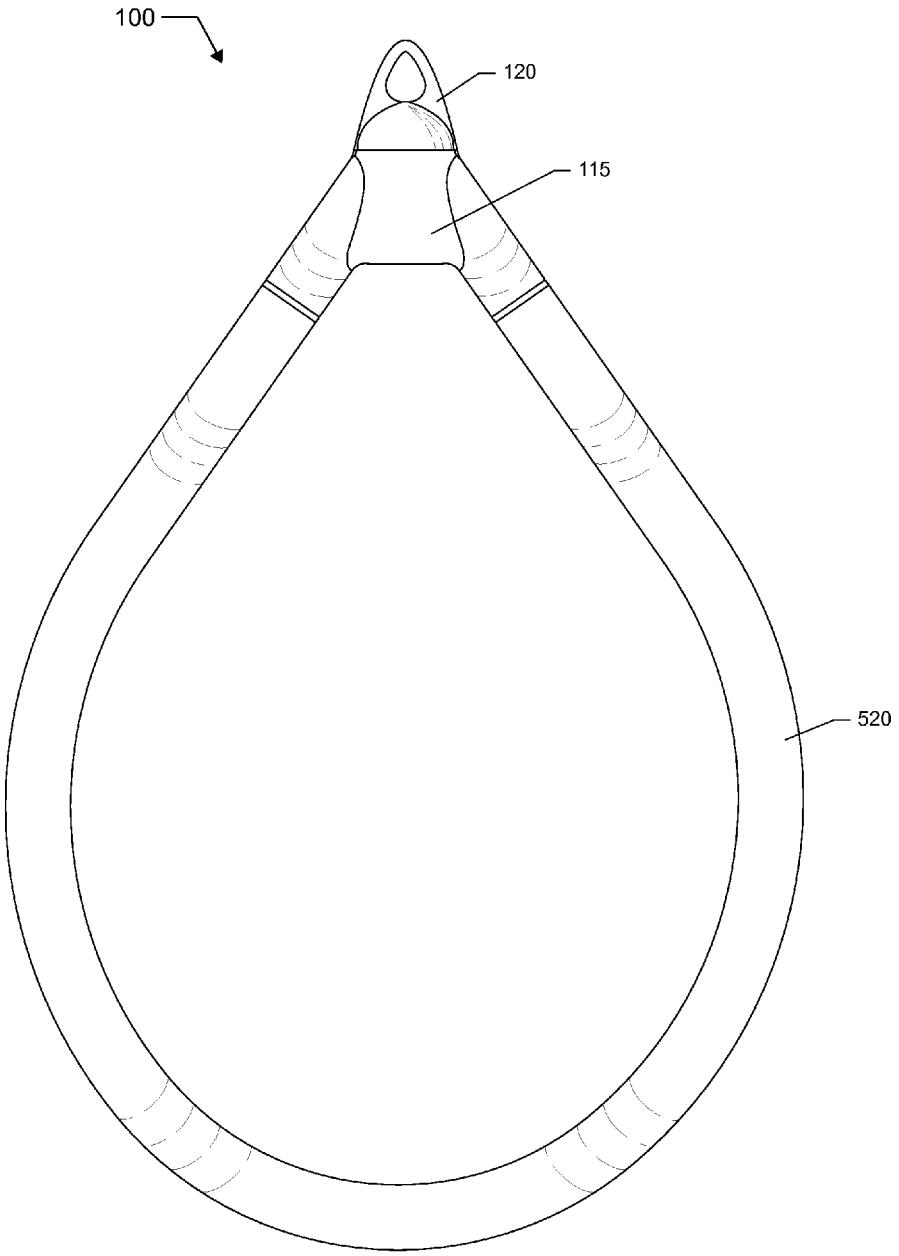
FIG. 2 is front view of a self-inflating device.
Figure 3:
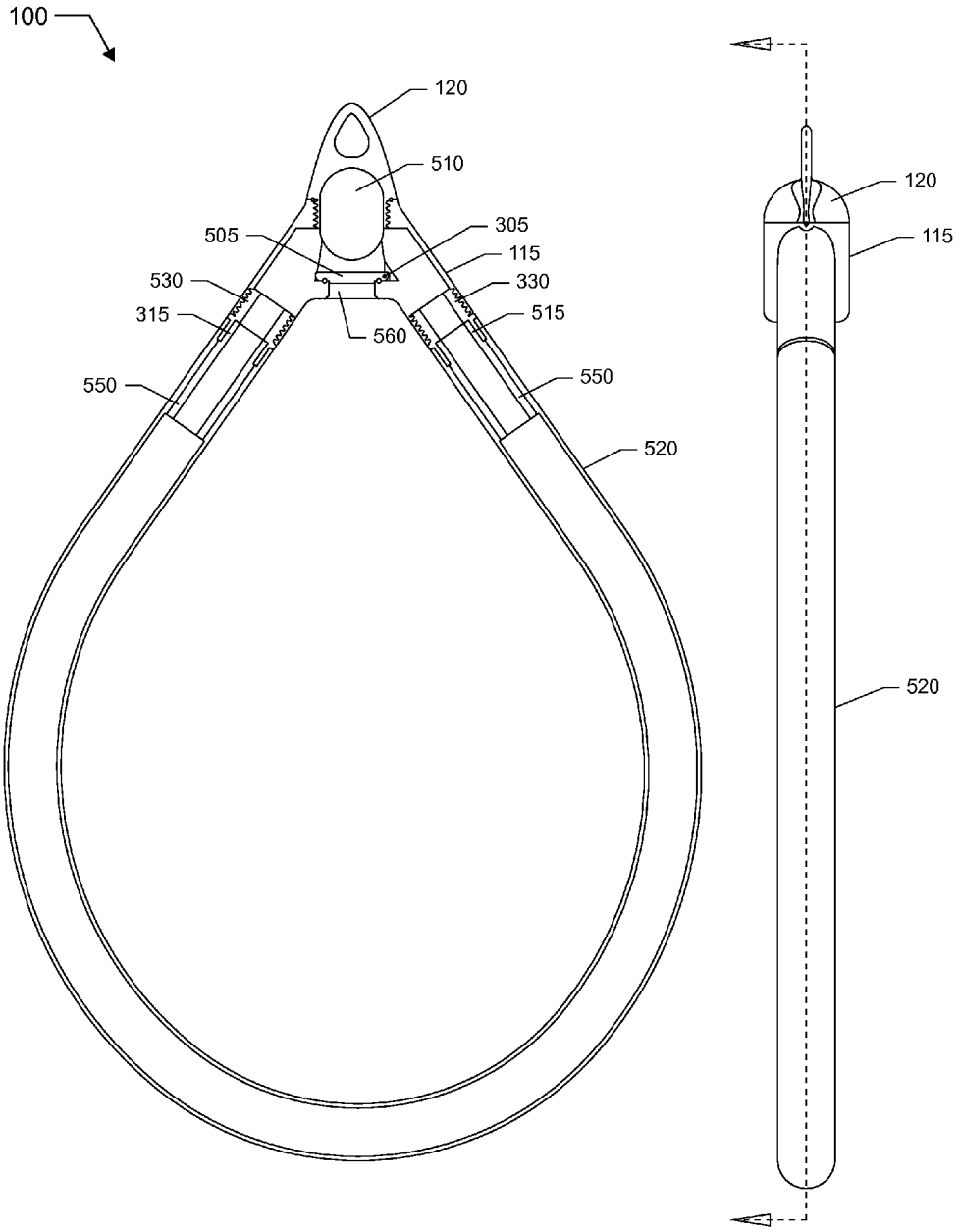
FIG. 3 is a front cross-sectional view of a self-inflating device.
Figure 4:
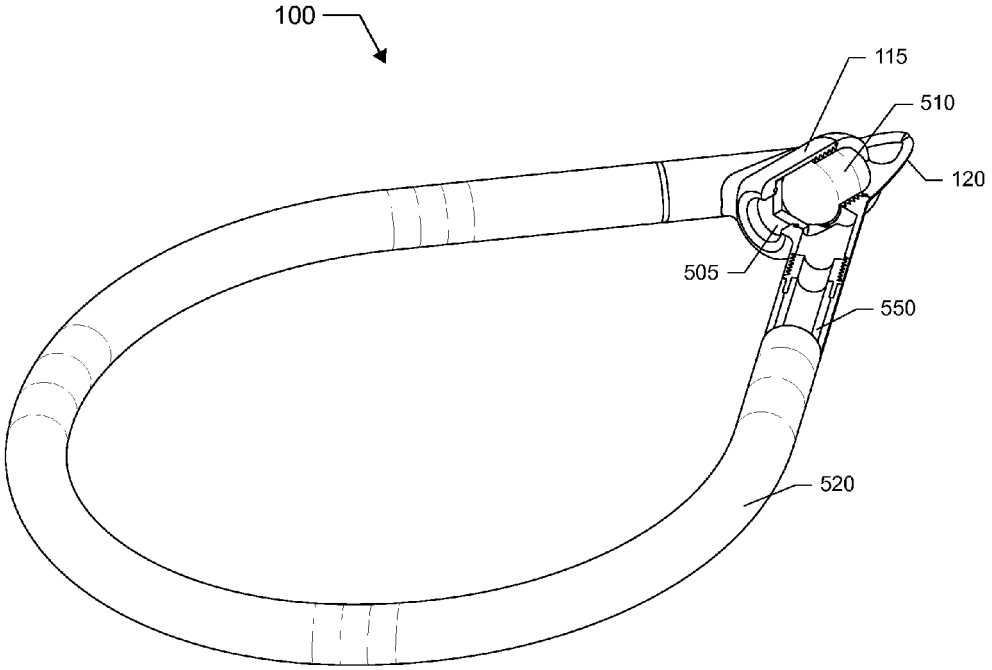
FIG. 4 is a perspective sectional view of a self-inflating device.
Figure 5:
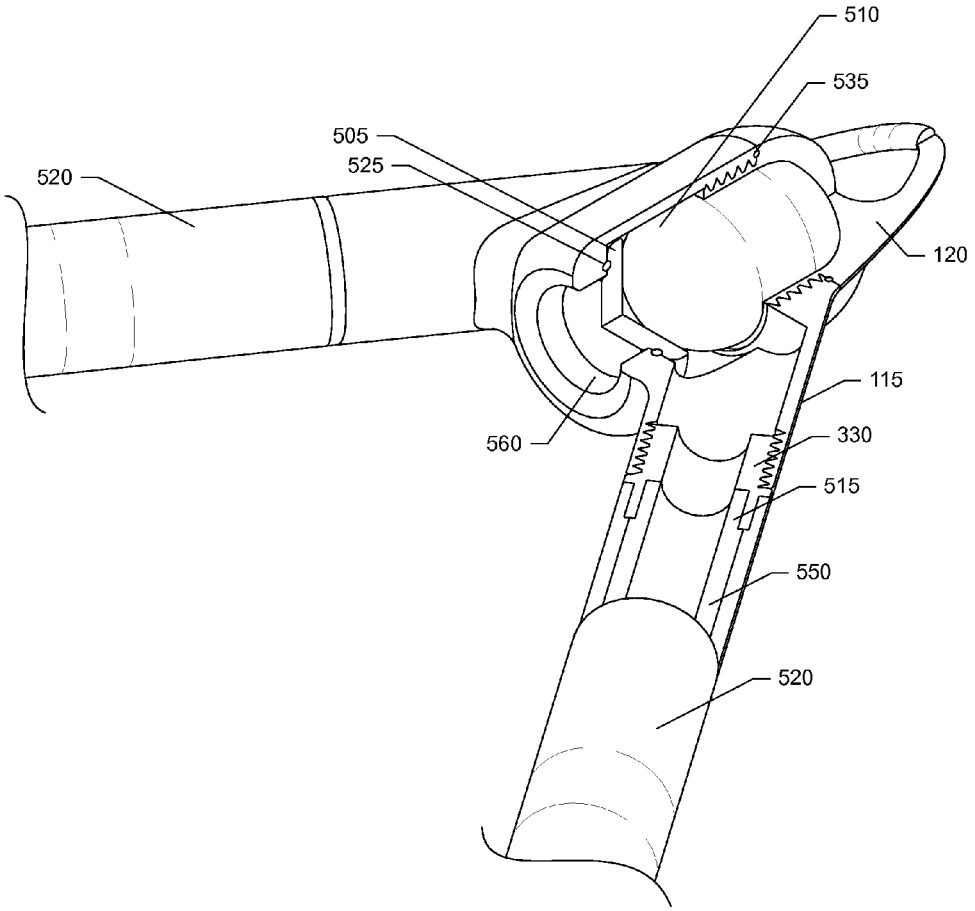
FIG. 5 is a perspective sectional view of a self-inflating device.
Figure 6:
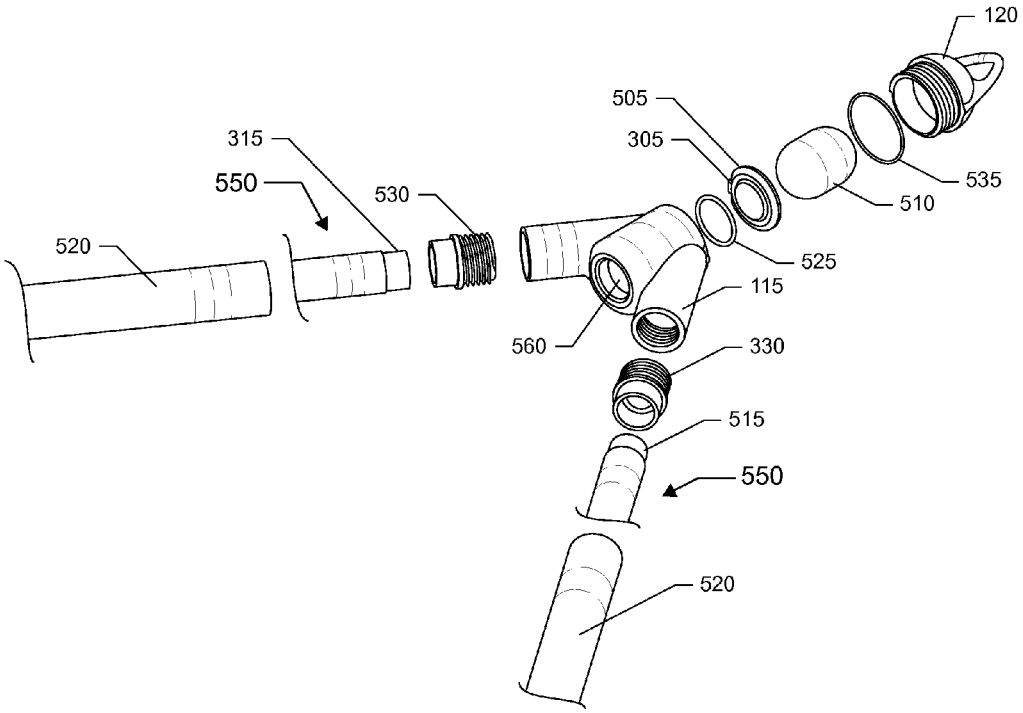
FIG. 6 is a perspective exploded view of a self-inflating device.
Figure 7:
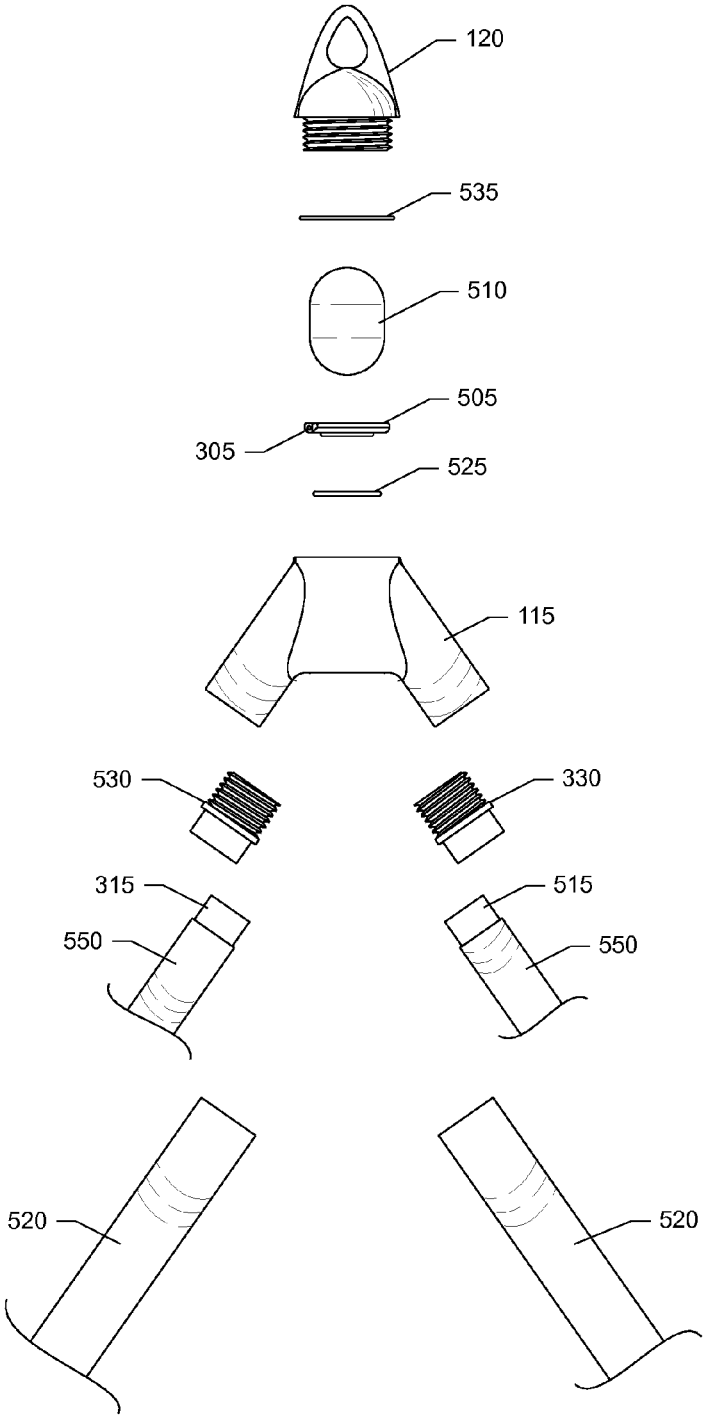
FIG. 7 is a front exploded view of a self-inflating device.

The self-inflating device 100 can include a removable cap 120 as shown in FIGS. 2 and 3. The removable cap 120 can be attachable to the container 115 by latches, press fit, snap fit, or any other suitable attachment mechanism. In another example, the removable cap 120 can attach to the container 115 by a threaded connection as shown in FIGS. 5 and 6. Detaching the removable cap 120 from the container 115 can allow access to the inner volume of the container. The removable cap 120 can include an attachment feature, such as a loop, hole, or opening, which can allow the self-inflating device 100 to be attached to the protective case 105. In one instance, a strap, cord, string, cable, tether, or other suitable connector can connect the attachment feature on the self-inflating device 100 to the attachment feature 110 on the protective case 105, as shown in FIG. 1.

The inner volume of the container 115 can be configured to receive a chemical compound. The chemical compound 115 can be added to the inner volume of the container 115 in any suitable form, such as a solid tablet, powder, granules, gel, gel capsule, or liquid solution. In one example shown in FIG. 5, the chemical compound 510 can be a solid tablet. The chemical compound 510 can be inserted into the inner volume of the container 115 through an opening formed by detaching the removable cap 120 from the container. In another example, the container 115 can include any other suitable point of access to the inner volume of the container to allow for insertion of the chemical compound 510, including but not limited to a hinged door, a removable door, a resealable membrane, or a slot covered by a movable gate.

In another example, the chemical compound 510 can be installed in the container 115 during manufacturing of the self-inflating device 100. In this example, the container 115 can be sealed to prevent the user from accessing the chemical compound 510 and to avoid requiring the user to complete the step of loading the chemical compound 510 into the container, which some users may find undesirable. When the chemical compound 510 is preloaded in the container 115, the container can be replaceable to allow the user to replace a spent (i.e. used) container with a fresh (i.e. unused) container.

In one example, the cap 120 can include a seal, such as an O-ring 535 as shown in FIGS. 5 and 6 to prevent gas or fluid from escaping from the inner volume of the container 115 at an interface formed between the cap 120 and the container. The material of the O-ring 535 can be selected based on, at least in part, compatibility with the chemical compound 510, compatibility with reaction products, estimated temperature range, estimated pressure range, space constraints, durability, and desired durometer. In one example, the O-ring 535 can be made of acrylonitrile butadiene styrene (ABS), polyoxymethylene (POM), KAPTON, biaxially-oriented polyethylene terephthalate (boPET), nylon, polyester, polyethylene, polypropylene, polystyrene, polyvinyl chloride (PVC), polytetrafluoroethylene (PTFE), urethane, or VITON. Although an O-ring 535 is shown, this is not limiting. Any other suitable type of seal, gasket, pressure fit, etc. can be used to seal the interface between the cap 120 and the container 115.

In one example, the container 115 can include a one-way valve 505 that covers an opening 560 in the container, as shown in FIGS. 5 and 6. The one-way valve 505 can allow fluid to flow in one direction into the container 115. The one-way valve 505 can attach to the container proximate to an opening 560 in the container 115 so that fluid, such as water, can enter the container but is restricted from exiting the container through the one-way valve 505. The one-way valve 505 can be configured to actuate when an outer surface of the valve is exposed to a pressure that is greater than or equal to an actuation pressure. The actuation pressure of the one-way valve 505 can be fixed or adjustable. In one example, the actuation pressure of the one-way valve 505 can be a pressure that is greater than atmospheric pressure.

Elevation, temperature, and humidity affect atmospheric pressure. When the self-inflating device 100 is used above sea level or at temperature or humidity levels that deviate from standard conditions, the actuation pressure of the one-way valve 505 can be selected to account for these variations to ensure that the one-way valve actuates at the proper depth. With all other variables held constant, atmospheric pressure decreases as elevation increases. For example, at sea level at standard temperature, atmospheric pressure is about 14.7 psi, at 2,500 feet above sea level at standard temperature, atmospheric pressure is about 13.5 psi, and at 5,000 feet above sea level at standard temperature, atmospheric pressure is about 12.3 psi. The actuation pressure of the one-way valve 505 can be decreased when the self-inflating device 100 is used at higher elevations to ensure that the one-way valve actuates at the proper depth. For instance, at 5,000 feet above sea level at standard temperature, the one-way valve 505 can be configured to actuate when the outer surface of the valve is exposed to a pressure greater than about 12.3 psi, which corresponds to atmospheric pressure at that elevation.

In salt water, the pressure increases about 0.445 psi per foot of depth in the water column. Water pressure at a certain depth can be calculated by adding the atmospheric pressure to a pressure contribution from being at a certain depth in the water column. For example, the water pressure at a depth of 0.5 feet is equal to the atmospheric pressure (~14.7 psi) plus the pressure contribution from being at 0.5 feet beneath the surface of the body of water (~0.2 psi), which results in a total pressure of about 14.9 psi. Thus, when a body of water is at sea level and the atmospheric pressure is equal to about 14.7 psi, the one-way valve 505 can be configured to actuate when the pressure acting on the one-way valve is greater than or equal to about 14.9 psi, which corresponds to the pressure at a depth of about 0.5 feet below sea level in salt water. In this example, the actuation pressure is 14.9 psi. In another example, the one-way valve 505 can be configured to actuate when the pressure acting on the one-way valve is about 15.1 psi, which corresponds to the pressure at a depth of about 1 foot below sea level in salt water. The one-way valve 505 can be configured to actuate when the pressure acting on the one-way valve is greater than or equal to about 16 psi, which corresponds to the pressure at a depth of about 3 feet below sea level in salt water. The one-way valve 505 can be configured to actuate when the pressure acting on the one-way valve is greater than or equal to about 16.9 psi, which corresponds to a pressure at a depth of about 5 feet below sea level in salt water. The one-way valve 505 can be configured to actuate when the pressure acting on the one-way valve is greater than or equal to about 19.1 psi, which corresponds to a pressure at a depth of about 10 feet below sea level in salt water. The one-way valve 505 can be configured to actuate when the pressure acting on the one-way valve is greater than or equal to about 21.4 psi, which corresponds to the pressure at a depth of about 15 feet below sea level in salt water. The one-way valve 505 can be configured to actuate when the pressure acting on the one-way valve is greater than or equal to about 23.6 psi, which corresponds to a depth of about 20 feet below sea level in salt water. In salt water at sea level, the one-way valve 505 can be configured to actuate when the outer surface of the one-way valve is exposed to a pressure greater than or equal to about 14.7-23.6, 14.9-23.6, 15.1-23.6, 16-23.6, 16.9-23.6, 19.1-23.6, or 21.4-23.6 psi.

In fresh water, the pressure increases about 0.432 psi per foot of depth in the water column. When a body of water is at sea level and the atmospheric pressure is equal to about 14.7 psi, the one-way valve 505 can be configured to actuate when the pressure acting on the one-way valve is greater than or equal to about 14.9 psi, which corresponds to a pressure at a depth of about 0.5 feet below sea level in fresh water. In this example, the actuation pressure is 14.9 psi. In another example, the one-way valve 505 can be configured to actuate when the pressure acting on the one-way valve is greater than or equal to about 15.1 psi, which corresponds to a pressure at a depth of about 1 foot below sea level in fresh water. The one-way valve 505 can be configured to actuate when the pressure acting on the one-way valve is greater than or equal to about 16 psi, which corresponds to the pressure at a depth of about 3 feet below sea level in fresh water. The one-way valve 505 can be configured to actuate when the pressure acting on the one-way valve is greater than or equal to about 16.9 psi, which corresponds to a pressure at a depth of about 5 feet in fresh water. The one-way valve 505 can be configured to actuate when the pressure acting on the one-way valve is greater than or equal to about 19.0 psi, which corresponds to a pressure at a depth of about 10 feet below sea level in fresh water. The one-way valve 505 can be configured to actuate when the pressure acting on the one-way valve is greater than or equal to about 21.2 psi, which corresponds to the pressure at a depth of about 15 feet below sea level in fresh water. The one-way valve 505 can be configured to actuate when the pressure acting on the one-way valve is greater than or equal to about 23.3 psi, which corresponds to a depth of about 20 feet below sea level in fresh water. In fresh water at sea level, the one-way valve 505 can be configured to actuate when the outer surface of the one-way valve is exposed to a pressure greater than or equal to about 14.7-23.3, 14.9-23.3, 15.1-23.3, 16-23.3, 16.9-23.3, 19.0-23.3, or 21.2-23.3 psi.

When the container 115 is submerged to a depth at which the pressure is equal to or exceeds the actuation pressure of the one-way valve 505, the one-way valve can open and allow water to enter the inner volume of the container 115. In one example, when water contacts the chemical compound 510, a chemical reaction can be initiated that produces carbon dioxide or any other gas or combination of gases. For a self-inflating device 100 that is configured to be attached to a consumer product, such as a mobile device case, which may be used in close proximity to the user's body, it is desirable for the chemical reaction to produce a gas or gases that are nontoxic. The reaction rate of the chemical reaction can be sufficient to produce adequate gas pressure within the container 115 such that a certain portion of the gas will escape from the container through the one-way valve 505, but in doing so, will urge the one-way valve to close and seal against the container, thereby preventing additional gas from escaping from the inner volume of the container. As the chemical reaction progresses, additional gas may be produced, thereby increasing the gas pressure within the container 115. The gas pressure acting against an inner surface of the one-way valve 505 can exceed the water pressure acting against the outer surface of the one-way valve. Consequently, the one-way valve 505 can remain closed and can prevent pressurized gas from escaping from the container 115 as well as additional water from flowing into the container.

The container 115 can be fluidly connected to an inflatable portion 550. The term "fluidly connected" is used herein to describe a physical connection between two components that allows a fluid, such as a liquid or gas, to pass between the two components. The inflatable portion can serve as an inflatable bladder and can have any suitable shape and dimensions. The inflatable portion 550 can be gas-impermeable or waterproof such that it is able to contain the gas created by the chemical reaction sufficient to float the electronic device to or near the surface of the water for a period of time adequate to permit location or retrieval of the electronic device. For instance, the inflatable portion 550 can be an inflatable, flexible portion, such as a rubber membrane, that is gas-impermeable and waterproof. In one example, the inflatable portion can be an inflatable tube 550, as shown in FIGS. 3 and 5-7. The inflatable tube 550 can include a first end 515 and a second end 315. The first and second ends (515, 315) can each be fluidly connected to the inner volume of the container 115, as shown in FIG. 3. The connections between the first and second ends (515, 315) and the container 115 can be airtight to prevent the escape of pressurized gases or liquids. The inflatable portion 550 can be made of any suitable material, such as an elastomer. For example, the inflatable portion 550 can be made of latex, natural rubber, butyl rubber, polychloroprene, polyethylene, polypropylene, ethylene propylene diene monomer (EPDM) rubber, fluoroelastomer, nitrile, ethylene-propylene rubber, PVC, or combinations thereof. In another example, the inflatable portion 550 can include a fabric containing natural or synthetic fibers covered with a polymer or rubber film that is impermeable to gas and water, such as HYPALON. The inflatable portion 550 can have any suitable dimensions. In one example, the inflatable portion 550 can have an deflated outer diameter of about 0.0625-2.0, 0.125-1.0, 0.0.25-0.75, 0.25-0.5, or 0.25-0.375 inches, and a length of about 1-12, 2-10, 3-8, or 5-7 inches.

The inflatable portion 550 can be configured to inflate when the gas pressure within the self-inflating device 100 exceeds the water pressure outside the self-inflating device. As the inflatable portion 550 inflates with gas produced by the chemical reaction of the chemical compound 510, the inflatable portion can increase in volume and can displace water in the body of water. Consequently, the overall buoyancy of the self-inflating device 100 can increase, causing the self-inflating device 100 to rise in the water column toward the surface of the body of water where a user can easily retrieve the self-inflating device, as well as a protective case 105 or electronic device that is attached to the self-inflating device. FIG. 8 shows an inflated self-inflating device 100 carrying an electronic device installed in a protective case 105 to the surface of a body of water. As shown in FIG. 8, the inflatable portion 550 can expand in volume due to an increase in gas pressure within the inflatable portion resulting from the chemical reaction of the chemical compound 510 after exposure to water. The additional buoyant force provided by the inflation of the inflatable portion 550 can be sufficient to lift the electronic device toward the surface of the body of water where it can be easily retrieved by the user.

The self-inflating device 100 can include a protective covering 520 over the inflatable portion 550, as shown in FIGS. 1-7. The protective covering 520 can protect the inflatable portion 550 from cuts, punctures, or abrasions that could result in leakage when pressurized. The protective covering 520 can be a surface coating on an outer surface of the inflatable portion 550. Alternately, the protective covering 520 can be a separate component that covers an outer surface of the inflatable portion 550. In one example, the protective covering 520 can be a braided fabric sleeve configured to cover the inflatable tube 550. Due to its construction, a braided fabric sleeve can increase in diameter to accommodate a physical expansion of the inflatable portion 550 as it expands in response to increasing gas pressure within the self-inflating device 100. In one example, the protective covering 520 can be made of nylon multifilament. Nylon multifilament has attributes, including fabric-like softness, high flexibility, positive buoyancy, and adequate toughness, that make it a desirable protective covering 520. In addition, nylon multifilament is lightweight and is resistant to common chemicals and ultraviolet damage and will not rot or retain moisture. Consequently, nylon multifilament can be a good material choice for a protective covering 520 that will likely be exposed to water or weather.

The protective covering 520 can be removable from the inflatable portion 550. In one example, a first connection 530 can be included where the first end 515 of the inflatable tube 550 fluidly connects to the container 115, as shown in FIGS. 3 and 6. Likewise a second connection 330 can be included where the second end 315 of the inflatable tube 550 fluidly connects to the container 115. The inflatable tube 550 can be detachable from the container 115 at either the first or second connection (330, 530) to free at least one end of the inflatable tube. Once one end of the inflatable tube 550 is freed, the protective covering 520 can be removed from the inflatable tube 550, such as by sliding it off of the inflatable tube. This feature can be desirable if the protective covering 520 becomes damaged and no longer provides adequate protection for the inflatable tubing 550. In one example, the protective covering 520 can be swapped with a protective covering made from a different material having an attribute that is desirable for a planned use. For instance, if the user is planning to use the self-inflating device 100 in murky water, the user may want to install a protective covering 520 having luminescence, which can make the self-inflating device 100 easier to locate in murky water. In another example, the protective covering 520 can be swapped with a protective covering having a different color (e.g. red, blue, green, yellow, silver, black, etc.), which can make the user's self-inflating device 100 easier to differentiate from similar self-inflating devices belonging to other users.

The self-inflating device 100 can include a light emitting diode (LED) to allow a user to more easily locate the self-inflating device if it becomes lost in murky water or in any other low light condition. The LED can be configured to blink to attract the user's attention. The LED can be activated when the one-way valve 505 is opened or when the inflatable portion 550 expands. In one example, a sensor can be mounted proximate the one-way valve 505 and can detect that the one-way valve has opened. In another example, a sensor can be mounted in the inflatable portion 550 and can detect when the inflatable portion begins to expand. In yet another example, a sensor can be mounted in the self-inflating device 100 and can detect when water has entered an inner volume of the self-inflating device 100. Based on feedback from any of these sensors, a circuit in the self-inflating device can determine when to deliver electrical current to the LED. Current can be delivered to the LED from a battery housed in the self-inflating device 100. In one example, the battery can be disposed in the container 115 and sealed with epoxy or another suitable material to protect it from water, the chemical compound 510, and reaction products. In another example, the LED can be actuated by the user with a switch, button, or other suitable actuation mechanism mounted on the self-inflating device 100.

The one-way valve 505 can be any suitable type of one-way valve. In one example, the one-way valve 505 can be a flap with a hinge 305, as shown in FIGS. 3 and 6. The hinge 305 can include a torsion spring that is configured to resist opening of the one-way valve 505. In particular, the torsion spring can resist opening of the one-way valve 505 and can urge the one-way valve to close and seal against the opening 560 in the container 115. The spring force of the torsion spring can dictate the actuation pressure of the one-way valve 505. Therefore, it can be desirable to have a torsion spring that is replaceable to allow the user to adjust the actuation pressure of the one-way valve 505.

In another example, the one-way valve 505 can be a ball check valve. The ball check valve can include a spring member that is housed within the container 115 and provides a spring force acting against a ball, similar to a ball check valve described in U.S. Pat. No. 4,091,839 to Donner, which is hereby incorporated by reference in its entirety. The ball can seat and seal against an inner perimeter of the opening 560 in the container 115 in response to the spring force exerted by the spring member housed in the container. When the force acting on the ball due to water pressure outside of the container exceeds the spring force urging the ball against the inner perimeter of the opening 560 in the container 115, the ball will unseat from the opening in the container and permit water to enter the container. Once the chemical reaction of the chemical compound 510 begins producing sufficient quantities of gas within the container 115, the gas pressure within the container will force the ball to reseat against the inner perimeter of the opening 560 in the container 115, thereby resealing the container and permitting inflation of the inflatable portion 550.

In another example, the one-way valve 505 can include a hinge 305 that can be a living hinge, as described in U.S. Patent Application Publication No. 2007/0240772 to Durrani, which is hereby incorporated by reference in its entirety. The living hinge can connect a mounting portion of the one-way valve 505 to a flap of the one-way valve. The mounting portion of the one-way valve can be mounted to the container 115 with a fastener, adhesive, press fit, snap fit, clip, or any other suitable method of attachment. The one-way valve 505 with flap and living hinge can be made of any suitable material, including any suitable rubber or polymer. The one-way valve 505 with the flap and living hinge can provide a lower cost solution than including a one-way valve with a torsion spring and can provide sufficient durability for a component that may not experience a substantial number of cycles during its lifetime. One-way valves 505 with living hinges are used in inflatable beach toys, which can be designed to endure a similar number of inflation cycles as the self-inflating device 100. A rubber or polymer-based one-way valve 505 can provide desirable corrosion-resistance when exposed to the chemical compound 510, salt water, or various reaction products.

The one-way valve 505 can seal against the container 115 by any suitable method to cover and seal the first opening 560. In one example shown in FIG. 5, the one-way valve 505 can seal against an O-ring 525 installed in an inner surface of the container 115 proximate and circumscribing the first opening 560 of the container 115. In another example, the one-way valve 505 can be made of a material, or can be coated with a material, that is capable of providing a watertight seal against a surface of the container 115. For instance, the one-way valve 505 can include a material having a durometer of 55-65, 55-70, 65-75, 55-90, or 70-90 on a Shore A scale, and can be capable of providing a watertight seal against a surface of the container 115. Suitable materials for the one-way valve can include ABS, POM, KAPTON, boPET, nylon, polyester, polyethylene, polypropylene, PVC, PTFE, urethane, VITON, latex, natural rubber, butyl rubber, polychloroprene, polypropylene, EPDM rubber, fluoroelastomer, nitrile, ethylene-propylene rubber, or a mixture, laminate, or edge-bonded combination of two or more such materials.

The removable cap 120 can allow the inner volume of the container 115 to be accessed for insertion of the chemical compound 510 before use, and can also allow for easy cleaning and removal of reaction products after use. In another example, the container may 115 not include a removable cap 120. Instead, the chemical compound 510 can be inserted through the one-way valve 505. For example, the user can depress the one-way valve 505 to access the opening 560 that leads to the inner volume of the container 115, and the user can then insert the chemical compound 510 into the container through the opening 560.

In another example, the entire container 115 can be detachable from the self-inflating device 100 so that instead of replacing the chemical compound 510 or changing the actuation pressure of the one-way valve 505, the user can simply swap out a first container 115 and replace it with a second container, which can include a quantity of unreacted chemical compound or may have a one-way valve with an actuation pressure that is greater than or less than the actuation pressure of the one-way valve on the first container.

The size of the inner volume of the container 115 can depend on the volume of chemical compound 510 that must be stored therein to produce a quantity of gas that creates a desired buoyant force. The inner volume of the container 115 can be larger for electronic devices having a greater mass (e.g. a tablet) and smaller for electronic devices having a lesser mass (e.g. a smartphone), since the inner volume of the container 115 can be configured to accommodate a sufficient quantity of chemical compound 510 to produce enough gas to render the combination of the self-inflating device 100 and electronic device positively buoyant.

The buoyant force (B) experienced by an object submerged in water is equal to ($\rho*V*g$), where $\rho$ is the density of water (e.g. 62.3 $lb/ft^3$ at 70° Fahrenheit), V is the volume of the object, and g is the Earth's gravitational acceleration (32.2 $ft/s^2$). When the self-inflating device 100 and protective case 105 are submerged in water, the buoyant force (B) provided by the displaced water acts in an upward direction, and the combined weight (W) of the self-inflating device and the protective case and its contents acts in a downward direction. If the buoyant force is less than the combined weight of the self-inflating device 100 and the protective case 105 and its contents, the self-inflating device and protective case will sink (i.e. if $B<W$). Alternately, if the buoyant force is greater than the combined weight of the self-inflating device 100 and the protective case 105 and its contents, the self-inflating device and protective case will float (i.e. if $B>W$).

Increasing the volume of the self-inflating device 100, such as by inflating the inflatable portion 550, increases the buoyant force acting on the self-inflating device. Equations 1 and 2 below represent instances where a combination of a self-inflating device 100 and a protective case 105 and its contents are positively buoyant. Equation 2 is identical to equation 1 except that the variables of each buoyant force are explicitly shown: Eqn 1: $(B_{protective\ case}+B_{self\text{-}inflating\ device})>(W_{protective\ case\ and\ its\ contents}+W_{self\text{-}inflating\ device})$; Eqn. 2: $(\rho_{water}*V_{protective\ case}*g)+(\rho_{water}*V_{self\text{-}inflating\ device}*g)>(W_{protective\ case\ and\ its\ contents}+W_{self\text{-}inflating\ device})$. If the self-inflating device 100 and the protective case 105 and its contents are negatively buoyant and sink, the reaction of the chemical compound must produce enough gas to increase the volume of the self-inflating device ($V_{self\text{-}inflating\ device}$) to a volume where the buoyant force acting on the self-inflating device ($B_{self\text{-}inflating\ device}$) has sufficient magnitude for the Equations 1 and 2 to hold true. Once the volume of the self-inflating device reaches a suitable volume for Equations 1 and 2 to hold true, the self-inflating device 100 and the protective case 105 and its contents will be carried to the surface of the body of water by the combined buoyant force ($B_{protective\ case}+B_{self\text{-}inflating\ device}$), as shown in FIG. 8.

In another example, the self-inflating device 100 may not include a container 115 with a chemical compound 510 contained therein. Instead, the inflatable portion 550 can include the chemical compound 510 within the inflatable portion. For example, the chemical compound 510 can be coated or applied on at least a portion of an inner surface of the inflatable portion 550. For instance, the chemical compound 510 can be coated or applied on an inner surface of the inflatable portion 550 in the form of a solid, powder, or gel. If coated, the coating can be applied using a spray coating process, a dip coating process, or any other suitable coating process. In another example, the chemical compound 510 can be a tablet or a water permeable bag or other suitable container containing the chemical compound and affixed to an inner surface of the inflatable portion 550 using an adhesive or mechanical fastener. In another example, the chemical compound can be impregnated into an inner surface of the inflatable portion 550. By positioning the chemical compound 510 within the inflatable portion 550, instead of within the container 115, the chemical compound 510 may not be easily accessible to the user. This can be a desirable safety feature, since it can prevent a child or animal from accidentally gaining exposure to the chemical compound 510. To further prevent accidental exposure to the chemical compound 510, the chemical compound 510 can be coated on an inner surface of the inflatable portion 550 near the middle of the inflatable portion and not near the ends (315, 515) of the inflatable portion. For example, the chemical compound may not be present within 1, 2, 3, 4, or 5 inches of the ends of the inflatable portion 550 where a child's finger could potentially reach the chemical compound 510 if inserted into an end of the inflatable portion 550 when the self-inflating device 100 is disassembled.

In an example where the self-inflating device 100 does not include a container 115, the first and second ends (515, 315) can be fluidly connected to each other by any suitable method of attachment. The connection between the first and second ends (515, 315) can be airtight and watertight to prevent the escape of pressurized gases or liquids, and can include any suitable sealing mechanism. In this example, the one-way valve 505 can be installed in the inflatable portion 550, since no container 115 is present. The one-way valve 505 can provide a passage for water to enter an inner volume of the inflatable portion 550 when the self-inflating device 100 is submerged in a body of water. The chemical compound 510 within the inflatable portion 550 can react with the water to produce carbon dioxide or any other gas or gases. The reaction rate can be sufficient to produce adequate gas pressure within the inflatable portion 550 such that a certain portion of the gas will escape from the inflatable portion through the one-way valve 505, but in doing so, will urge the one-way valve to close and seal the inflatable portion. As the chemical reaction progresses, additional gas can be produced, thereby increasing the gas pressure within the inflatable portion 550. The gas pressure acting against an inner surface of the one-way valve 505 can exceed the water pressure acting against the outer surface of the one-way valve. Consequently, the one-way valve 505 can remain closed and can prevent additional water from flowing into the inflatable portion 550. Upon closing, the one-way valve 505 can also prevent gas from escaping from the inflatable portion 550. As a result, gas generated by the chemical reaction will accumulate within the inflatable portion 550. As the pressure of the accumulating gas increases, the volume of the inflatable portion 550 will expand as its flexible material yields to increasing gas pressure. As the inflatable portion 550 expands in volume, it will displace water in the body of water and will eventually provide sufficient buoyancy to return the self-inflating device 100 and protective case 105 and its contents to the surface of the body of water.

In another example where the self-inflating device 100 does not include a container 115, the first and second ends (515, 315) may not be fluidly connected to each other. Instead, the first and second ends (515, 315) can each be sealed to form a sealed tube, and the one-way valve 505 can be installed anywhere along the length of the inflatable portion 550. The one-way valve 505 can provide a passage for water to enter an inner volume of the inflatable portion 550 when the self-inflating device is submerged in a body of water. The chemical compound 510 within the inflatable portion 550 can react with the water to produce carbon dioxide or any other gas or gases. The reaction rate can be sufficient to produce adequate gas pressure within the inflatable portion 550 such that a certain portion of the gas will escape from the inflatable portion through the one-way valve 505, but in doing so, will urge the one-way valve to close and seal the inflatable portion. As the chemical reaction progresses, additional gas can be produced, thereby increasing the gas pressure within the inflatable portion 550. The gas pressure acting against an inner surface of the one-way valve 505 can exceed the water pressure acting against the outer surface of the one-way valve. Consequently, the one-way valve 505 can remain closed and can prevent additional water from flowing into the inflatable portion 550. Upon closing, the one-way valve 505 will also prevent gas from escaping from the inflatable portion 550. As a result, gas generated by the chemical reaction will accumulate within the inflatable portion 550. As the pressure of the accumulating gas increases, the volume of the inflatable portion 550 will expand as its flexible material yields to increasing gas pressure. As the inflatable portion 550 expands in volume, it will displace water in the body of water and will eventually provide sufficient buoyancy to return the self-inflating device 100 and protective case 105 and its contents to the surface of the body of water.

In another example where the self-inflating device 100 does not include a container 115, the inflatable portion 550 may not be a tube with first and second ends (515, 315) as described above. Rather, the inflatable portion 550 can be an inflatable bladder having any suitable shape, such as a spherical shape similar to a balloon. In this example, the one-way valve 505 can be installed anywhere in the inflatable portion 550. The one-way valve 505 can provide a passage for water to enter an inner volume of the inflatable portion 550 when the self-inflating device 100 is submerged in a body of water. The chemical compound 510 within the inflatable portion 550 can react with the water to produce carbon dioxide or any other gas or gases. The reaction rate can be sufficient to produce adequate gas pressure within the inflatable portion 550 such that a certain portion of the gas will escape from the inflatable portion through the one-way valve 505, but in doing so, will urge the one-way valve to close and seal the inflatable portion. As the chemical reaction progresses, additional gas can be produced, thereby increasing the gas pressure within the inflatable portion 550. The gas pressure acting against an inner surface of the one-way valve 505 can exceed the water pressure acting against the outer surface of the one-way valve. Consequently, the one-way valve 505 can remain closed and can prevent additional water from flowing into the inflatable portion 550. Upon closing, the one-way valve 505 will also prevent gas from escaping from the inflatable portion 550. As a result, gas generated by the chemical reaction will accumulate within the inflatable portion 550. As the pressure of the accumulating gas increases, the volume of the inflatable portion 550 will expand as its flexible material yields to increasing gas pressure. As the inflatable portion 550 expands in volume, it will displace water in the body of water and will eventually provide sufficient buoyancy to return the self-inflating device 100 and protective case 105 and its contents to the surface of the body of water.

The self-inflating device 100 can be connected to the electronic device or protective case 105 in any suitable way, such as being connected to an attachment point 110 on an outer surface of the electronic device or protective case. In another example, the self-inflating device 100 can be housed in a compartment in the electronic device or protective case 105. The compartment can be located proximate a front, back, side, or end surface of the electronic device or protective case 105. The compartment can include a cover that closes to conceal and protect the self-inflating device 100. The compartment cover can include one or more openings that permit water to enter the compartment when submerged. Upon reaching a depth at which the one-way valve 505 is actuated and the chemical compound 510 reacts to produce gas, the inflatable portion 550 can inflate, and by doing so, can exert sufficient pressure against the cover to cause the cover to open, thereby releasing the self-inflating device 100 from the compartment and freeing the self-inflating device 100 to continue expanding to a point where it provides an adequate buoyant force to return the self-inflating device 100 and electronic device to the surface of the body of water.

The chemical compound 510 can be any suitable compound that, when exposed to freshwater or salt water, produces a gas. In one example, the chemical compound can include an acidic component and a basic component that dissolve into a solution when exposed to water, thereby allowing the acidic component and the basic component to mix and react to form a gas. The gas can be any gas, such as carbon dioxide or oxygen. In one example, the basic component of the chemical compound 510 can include sodium bicarbonate, and the acidic component of the chemical compound can include citric acid, which can react to form carbon dioxide gas, water, and sodium citrate. In yet another example, the basic component of the chemical compound 510 can include sodium bicarbonate, and the acidic component of the chemical compound can include tartaric acid, which can react to form carbon dioxide gas, hydrogen tartrate, and water. In still another example, the basic component of the chemical compound 510 can include sodium perborate, and the acidic component of the chemical compound can include acetic acid, which can react to form oxygen. In other examples, the basic component can include carbamide peroxide, hydrogen peroxide solution, or any other suitable basic component. The acidic component can be any suitable acidic component that is configured to react with the basic component to produce gas at a sufficient chemical reaction rate to close the one-way valve 505 and inflate the inflatable portion 550.

The self-inflating device 100 can include a pressure relief mechanism for safety purposes. In one example, the self-inflating device 100 can include a pressure relief valve (not shown) that allows pressurized gas to escape from the container 115 or inflatable portion 550 when the pressure exceeds a maximum safe operating pressure. The pressure relief valve can prevent the inflatable portion from rupturing or becoming damaged due to over-inflation. The maximum safe operating pressure can depend on the material properties of the various components of the self-inflating device 100, including the material properties of the container 115, inflatable portion 550, and connectors (e.g. 330, 530). The pressure relief valve can be mounted in the container 115 or in the inflatable portion, and can be any suitable type of valve. The actuation pressure of the pressure relief valve can be equal to the maximum safe operating pressure of the self-inflating device. The actuation pressure of the pressure relief valve can be preset or user-adjustable.

The actuation pressure corresponding to a depth at which the self-inflating device 100 inflates can be fixed or adjustable. In one example, the actuation pressure corresponding to a depth at which the one-way valve 505 actuates can be fixed at a preset value. For instance, that actuation pressure at which the one-way valve 505 actuates can be fixed at a preset value that corresponds to a depth of 1-5, 1-10, 1-25, 1-50, or 1-100 feet, or any other desirable depth. Where the depth at which the one-way valve 505 actuates is preset, the one-way valve 505 can be removable from the self-inflating device 100 to allow the user to attach a one-way valve 505 with a different preset value. For example, a user may want a one-way valve 505 with a preset value of 1 foot when fly-fishing in a swift moving stream on a first day, but may want a one-way valve with a preset value of 8 feet when snorkeling on a second day. Each preset value can correspond to an actuation pressure.

There are several ways for a user to modify a preset value of the one-way valve 505 in the self-inflating device 100. First, where the self-inflating device 100 includes a container 115, the one-way valve 505 can be removable from the container, and a one-way valve with a different preset value can be installed. Second, where the self-inflating device 100 does not include a container 115, and where the one-way valve 505 is installed in the inflatable portion 550, the one-way valve can be removable from the inflatable portion and a one-way valve with a different preset value can be installed in the inflatable portion. Third, where the self-inflating device 100 includes a container 115 with a permanently installed one-way valve 505, the container can be removable and a different container can be installed that has a one-way valve with a different preset value.

As noted above, the depth at which the self-inflating device 100 inflates can be adjustable. The one-way valve 505 can include an adjustment mechanism that allows the actuation pressure that is required to actuate the one-way valve to be increased or decreased. Where the hinge 305 of the one-way valve 505 includes a torsion spring, the torsion spring can be adjustable. For instance, the torsion spring can include an adjustment mechanism, such as a thumb wheel, that allows the user to adjust the spring force of the torsion spring to provide a range of actuation pressures to accommodate a variety of activities. For example, a user can adjust the torsion spring to actuate at an actuation pressure that corresponds to a depth of 1 foot when fly-fishing and can adjust the torsion spring to actuate at an actuation pressure corresponding to a depth of 8 feet when snorkeling. The thumb wheel can be configured to provide visual, audible, or tactile feedback to the user during adjustment to indicate the depth setting at which the one-way valve 505 will actuate. For instance, the thumb wheel can provide an audible click when rotated, and each click can correspond to a depth setting change of about 0.5, 1, 2, 3, 4, 5, 10, or 20 feet. The adjustment of the spring force can be linear on nonlinear. A nonlinear adjustment can allow for fine adjustment at shallow depths and course adjustment at greater depths, which may be desirable to some users. The thumb wheel can include numerical markings to allow the user to easily identify the depth setting of the one-way valve 505 through visual inspection.

Where the one-way valve 505 is a ball check valve as described above, the actuation pressure that is required to actuate the one-way valve can be adjustable. The adjustment mechanism can be a threaded portion that can be turned to increase or decrease the compression of the spring member against the ball to increase or decrease, respectively, the actuation pressure that is required to actuate the one-way valve 505. For example, the threaded portion can be threaded through the container 115 and can contact a first end of the spring member, and a second end of the spring member can contact the ball. By tightening the threaded portion into the container 115, the user can compress the spring member against the ball and can increase the actuation pressure that is required to actuate the one-way valve 505. Conversely, by backing the threaded portion out of the container 115 several turns, the user can decrease the compression of the spring member against the ball and can decrease the actuation pressure that is required to actuate the one-way valve 505. An adjustment mechanism with a threaded portion and a thumbwheel (i.e. knob) is described in U.S. Pat. No. 4,112,959 to Jaekel, which is hereby incorporated by reference in its entirety.

The adjustment mechanism can be any suitable adjustment mechanism. In another example, the one-way valve 505 can include an adjustment mechanism that employs magnets as described in U.S. Patent Application Publication No. 2008/0128033 to McGonigle et al., which is hereby incorporated by reference in its entirety.

When a user lacks the chemical compound 510 for use in the self-inflating device 100, the user can manually inflate the self-inflating device to avoid losing the electronic device in a body of water. For example, if a user lacks the chemical compound 510 while offshore fishing, the user can preemptively inflate the inflatable portion 550 by blowing forcefully into the one-way valve 505. Then, if the user accidentally drops the electronic device in the body of water, the combination of the electronic device and the self-inflating device will have sufficient buoyancy to prevent both from sinking.

Although examples of a self-inflating device 100 for use with a protective case 105 or an electronic device are described herein, this is not limiting. The self-inflating device described herein 100 provides utility in many other applications. For instance, the self-inflating device 100 can be used to recover any type of submerged object. In one example, larger versions of the self-inflating device 100 can be used to recover a vehicle, such as automobile, snowmobile, or all-terrain vehicle, from a frozen lake or river where the vehicle has broken through thin ice and become submerged. Recovering a submerged vehicle can be a difficult and costly process, and often requires cranes or other heavy equipment that must be operated on the same thin ice that could not support the weight of the submerged vehicle. As an alternative to the existing recovery methods, a single diver can descend to the submerged vehicle and can attach one or more self-inflating devices 100 to the submerged vehicles using any suitable method of attachment, including using a high-strength cable or rope. The one-way valve 505 on the self-inflating device can then be actuated by any suitable method, including actuation from water pressure, manual actuation by the diver, or remote actuation. Remote actuation of the one-way valve 505 can require a physical tether extending from the one-way valve to a remote user. Alternately, remote actuation can include well-known electronic control systems, which can be wireless or wired. No matter the method of actuation, once the one-way valve 505 has been actuated, a chemical reaction involving the chemical compound 510 can cause the inflatable portion 550 of the self-inflating device 100 to expand. When the expansion of the inflatable portion 550 is sufficient to contribute to a buoyant force that is greater than the combined weight of the submerged vehicle and the self-inflating device, the self-inflating device will return the vehicle to the surface where workers can easily recover the vehicle. The self-inflating device 100 can then be reused after removing reaction products from the container 115 and inserting a new load of chemical compound 510 into the container.

In one example, a self-inflating device can include a container configured to receive a chemical compound, where the chemical compound can be configured to produce a gas when exposed to water. The self-inflating device can also include a one-way valve covering an opening leading to an inner volume of the container, where the one-way valve can be configured to open and allow water into the inner volume of the container when the self-inflating device is submerged in water to a depth where a pressure applied against an outer surface of the one-way valve is greater than or equal to an actuation pressure. The self-inflating device can also include an inflatable portion fluidly connected to the inner volume of the container and configured to inflate with gas produced when the chemical compound is exposed to water. The actuation pressure of the one-way valve can be greater than atmospheric pressure. For instance, the actuation pressure of the one-way valve can be about 14.9-23.6 psi. The inflatable portion can be an inflatable tube having a first end and a second end, where the first and second ends of the inflatable tube are each fluidly connected to the container to form a lanyard. The inflatable portion can be gas-impermeable and waterproof and the inflatable portion can include an elastomer. The self-inflating device can include a protective covering over the inflatable portion, where the protective covering includes nylon multifilament. The one-way valve can have a fixed or adjustable actuation pressure. The self-inflating device can also include a removable cap attached to the container, where the removable cap allows the inner volume of the container to be accessed for cleaning or insertion of the chemical compound.

In one example, a self-inflating device can include an inflatable portion configured to receive a chemical compound, where the chemical compound is configured to produce a gas when exposed to water. The self-inflating device can also include a one-way valve covering an opening in the inflatable portion, where the opening leads to an inner volume of the inflatable portion, where the one-way valve is configured to open and allow water into the inner volume of the inflatable portion when the self-inflating device is submerged in water to a depth where a pressure applied against an outer surface of the one-way valve is greater than or equal to an actuation pressure, and where the inflatable portion is configured to inflate with gas produced when the chemical compound is exposed to water. The actuation pressure of the one-way valve can be greater than atmospheric pressure. The inflatable portion can be gas-impermeable and waterproof, and can include an elastomer.

The chemical compound can include any suitable acidic component and any suitable basic component. In one example, the basic component can include sodium bicarbonate, and the acidic component can include citric acid. In another example, the basic component can include sodium bicarbonate and the acidic component can include tartaric acid. In yet another example, the basic component can include sodium perborate, and the acidic component can include acetic acid.

The foregoing description has been presented for purposes of illustration and description. It is not intended to be exhaustive or to limit the claims to the embodiments disclosed. Other modifications and variations may be possible in view of the above teachings. The embodiments were chosen and described to explain the principles of the invention and its practical application to enable others skilled in the art to best utilize the invention in various embodiments and various modifications as are suited to the particular use contemplated. It is intended that the claims be construed to include other alternative embodiments of the invention except insofar as limited by the prior art.

What is claimed is:

1. A pressure-activated flotation device for use with an electronic device, the pressure-activated flotation device comprising:

an attachment feature for attaching the pressure-activated flotation device to the electronic device;

one or more chemicals that produce an expanding gas when exposed to a liquid;

a container having an outer surface and an inner volume for storing the one or more chemicals;

a removable cap for accessing the inner volume of the container;

an inflatable tube fluidly connected to the container and attached to the attachment feature, the inflatable tube having a first end, a second end, and an inner volume, the inflatable tube configured to inflate with the expanding gas when the one or more chemicals are exposed to the liquid in the container; and a pressure-activated valve leading from the outer surface of the container to the inner volume of the container, wherein the pressure-activated valve includes a one-way valve configured to:

open to allow liquid at the outer surface of the container to flow to the inner volume of the container when the pressure-activated flotation device is submerged in the liquid to a depth where a pressure applied against the pressure-activated valve by the liquid is greater than an actuation pressure of the pressure-activated valve; and close when the expanding gas generates a gas pressure inside the inflatable tube that exceeds a threshold.

2. The pressure-activated flotation device of claim 1, wherein the inflatable tube comprises an elastomer and is substantially gas-impermeable and waterproof.

3. The pressure-activated flotation device of claim 1, wherein the actuation pressure of the one-way valve is greater than atmospheric pressure.

4. The pressure-activated flotation device of claim 1, wherein the one or more chemicals comprise an acidic component and a basic component.

5. The pressure-activated flotation device of claim 4 wherein the basic component comprises sodium bicarbonate and the acidic component comprises citric acid.

6. The pressure-activated flotation device of claim 4, wherein the basic component comprises sodium bicarbonate and the acidic component comprises tartaric acid.

7. The pressure-activated flotation device of claim 4, wherein the basic component comprises sodium perborate and the acidic component comprises acetic acid.

8. The pressure-activate flotation device of claim 1 wherein the actuation pressure of the pressure-activate valve is adjustable.

9. A self-inflating device comprising:

a container having an inner volume for receiving a chemical compound that produces an expanding gas when exposed to water;

a removable cap for accessing the inner volume of the container;

a one-way valve covering an opening leading to the inner volume of the container, wherein the one-way valve is configured to open to allow water from outside the container into the inner volume of the container when the self-inflating device is submerged in the water to a depth where a pressure applied against an outer surface of the one-way valve by the water is greater than or equal to an actuation pressure of the one-way valve; and an inflatable tube fluidly connected to the inner volume of the container and configured to inflate with the gas expanding produced when the chemical compound is exposed to the water such that a pressure produced by the expanding gas in the inflatable tube closes the one-way valve.

10. The self-inflating device of claim 9, wherein the inflatable tube comprises an elastomer and is gas-impermeable and waterproof.

11. The self-inflating device of claim 9, wherein the actuation pressure is adjustable.

12. The self-inflating device of claim 9, wherein the actuation pressure of the one-way valve is greater than atmospheric pressure.

13. The self-inflating device of claim 9, wherein the actuation pressure of the one-way valve is about 14.9-23.6 psi.

14. The self-inflating device of claim 9, wherein the chemical compound comprises an acidic component and a basic component.

15. The self-inflating device of claim 9, further comprising an attachment feature for attaching the self-inflating device to an electronic device.

16. The self-inflating device of claim 9, further comprising a protective covering disposed over the inflatable tube.

17. The self-inflating device of claim 16, wherein the protective covering disposed over the inflatable tube comprises nylon multifilament.

18. A pressure-activated flotation device for use with an electronic device, the pressure-activated flotation device comprising:

one or more chemicals that produce an expanding gas when exposed to water;

an inflatable bladder having an outer surface and an inner volume, the one or more chemicals stored in the inner volume of the inflatable bladder;

a removable cap on the container for accessing the inner volume of the inflatable bladder;

a one-way valve leading to the inner volume of the inflatable bladder, the one-way valve configured to open to allow water on the outside of the pressure-activated flotation device to reach the one or more chemicals in the inner volume of the inflatable bladder when the pressure-activated flotation device is submerged in water to a depth where a pressure applied against the pressure-activated valve by the water is greater than an actuation pressure of the pressure-activated valve, the water reacting with the one or more chemicals to produce the expanding gas to inflate the inflatable bladder; and an attachment feature for attaching the pressure-activated flotation device to the electronic device.

19. The pressure-activated flotation device of claim 18 wherein a pressure produced by the expanding gas in the inflatable bladder closes the one-way valve.

20. The pressure-activated flotation device of claim 18 further comprising a protective cover for the inflatable bladder.

* * * * *